US008464536B2

(12) United States Patent
Böttcher et al.

(10) Patent No.: US 8,464,536 B2
(45) Date of Patent: Jun. 18, 2013

(54) GAS TURBINE COMBUSTION CHAMBER

(75) Inventors: Andreas Böttcher, Mettmann (DE); Olga Deiss, Düsseldorf (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/414,051

(22) Filed: Mar. 7, 2012

(65) Prior Publication Data

US 2012/0234009 A1 Sep. 20, 2012

(30) Foreign Application Priority Data

Mar. 15, 2011 (EP) ..... 11158268

(51) Int. Cl.
*F02C 7/24* (2006.01)

(52) U.S. Cl.
USPC ..... 60/725; 60/752

(58) Field of Classification Search
USPC ..... 60/725, 752–760; 431/114
See application file for complete search history.

(56) References Cited

U.S. PATENT DOCUMENTS

| | | | | |
|---|---|---|---|---|
| 2,938,333 | A * | 5/1960 | Wetzler | 60/766 |
| 3,186,168 | A * | 6/1965 | Ormerod et al. | 60/796 |
| 3,572,031 | A * | 3/1971 | Szetela | 60/757 |
| 3,589,128 | A * | 6/1971 | Sweet | 60/757 |
| 3,702,058 | A * | 11/1972 | De Corso et al. | 60/757 |
| 3,745,766 | A * | 7/1973 | Melconian | 60/39.23 |
| 3,793,827 | A * | 2/1974 | Ekstedt | 60/757 |
| 6,018,950 | A * | 2/2000 | Moeller | 60/752 |
| 6,826,913 | B2 * | 12/2004 | Wright | 60/772 |
| 7,104,065 | B2 * | 9/2006 | Benz et al. | 60/725 |
| 7,278,256 | B2 * | 10/2007 | Norris et al. | 60/204 |
| 2002/0088233 | A1 | 7/2002 | Ohnishi et al. | |
| 2003/0010014 | A1 * | 1/2003 | Bland et al. | 60/39.37 |
| 2004/0060295 | A1 | 4/2004 | Mandai et al. | |
| 2005/0034918 | A1 * | 2/2005 | Bland et al. | 181/250 |
| 2005/0097890 | A1 | 5/2005 | Ikeda et al. | |

FOREIGN PATENT DOCUMENTS

| | | |
|---|---|---|
| EP | 1221574 A2 | 7/2002 |
| EP | 1510757 A2 | 3/2005 |
| FR | 2191025 A1 | 2/1974 |
| GB | 1274414 A | 5/1972 |

* cited by examiner

*Primary Examiner* — Phutthiwat Wongwian

(57) ABSTRACT

A gas turbine combustion chamber is provided. The gas turbine includes a combustion chamber interior and a combustion chamber wall which has a substantially rotationally symmetrical cross-section, wherein on the side of the combustion chamber wall facing away from the combustion chamber interior there is arranged over the entire cross-sectional circumference of the combustion chamber wall a corrugated component which, in combination with the combustion chamber wall, embodies a plurality of separate resonance chambers and wherein openings are incorporated in the combustion chamber wall in such a way that a fluidic connection is established in each case between the combustion chamber interior and one of the resonance chambers and wherein the corrugated component has two locking rings which are connected to the combustion chamber wall in order to seal off the resonance chambers.

5 Claims, 1 Drawing Sheet

GAS TURBINE COMBUSTION CHAMBER

CROSS REFERENCE TO RELATED APPLICATIONS

This application claims priority of European Patent Office application No. 11158268.0 EP filed Mar. 15, 2011. All of the applications are incorporated by reference herein in their entirety.

FIELD OF INVENTION

The invention relates to a gas turbine combustion chamber, comprising a combustion chamber interior and a combustion chamber wall which has a substantially rotationally symmetrical cross-section.

BACKGROUND OF INVENTION

In the simplest case a gas turbine plant comprises a compressor, a combustion chamber and a turbine. Ingested air is compressed in the compressor and a fuel is then mixed therewith. The mixture is combusted in the combustion chamber, the exhaust gases from the combustion process being supplied to the turbine, by which energy is extracted from the combustion exhaust gases and converted into mechanical energy.

However, variations in fuel quality and sundry other thermal or acoustic perturbations lead to fluctuations in the quantity of heat released. At the same time an interaction takes place between acoustic and thermal perturbations which can produce increased vibrations. Thermoacoustic oscillations of this type in the combustion chambers of gas turbines—or indeed turbo machines in general—pose a problem in relation to the design and operation of new combustion chambers, combustion chamber components and burners for turbo machines of said type.

In modern-day plants the cooling medium mass flow rate is reduced in order to reduce noxious emissions. This also leads to a reduction in acoustic damping, with the result that thermoacoustic oscillations can increase. An intensifying interaction between thermal and acoustic perturbations can build up in the process which can cause the combustion chamber to be subjected to heavy stresses and lead to increasing emissions.

For this reason, in order to reduce thermoacoustic oscillations, devices such as Helmholtz resonators are used in the prior art as damping mechanisms which attenuate the amplitude of oscillations at specific frequencies.

Helmholtz resonators of this type dampen in particular the amplitude of oscillations at the Helmholtz frequency as a function of the cross-sectional surface area of the connecting tube and of the resonator volume. In most cases said Helmholtz resonators are small boxes which are individually welded on the combustion chamber wall of the gas turbine. However, this is very time-consuming, labor-intensive and expensive. Furthermore, these small boxes and their welded seam have only a very limited lifespan.

SUMMARY OF INVENTION

It is therefore the object of the present invention to disclose a gas turbine combustion chamber which avoids the above disadvantages.

This object is achieved according to the invention by means of a gas turbine combustion chamber comprising a combustion chamber interior and a combustion chamber wall which has a substantially rotationally symmetrical cross-section. On a side of the combustion chamber wall facing away from the combustion chamber interior there is arranged over the entire cross-sectional circumference of the combustion chamber wall a corrugated component which, in combination with the combustion chamber wall, embodies a plurality of separate resonance chambers. Openings are incorporated in the combustion chamber wall in such a way that a fluidic connection between the combustion chamber interior and one of the resonance chambers is established in each case. The corrugated component has two locking rings which are connected to the combustion chamber wall in order to seal off the resonance chambers. Accordingly, the resonance chambers are also embodied as cavity resonators. Frequencies can easily be damped by means of such a gas turbine combustion chamber. Such a corrugated component can also be installed easily and at reasonable cost. In this case the corrugated component can be mounted over the entire length of the combustion chamber wall. This enables efficient damping to be realized over the entire length of the combustion chamber wall. Alternatively, however, the corrugated component can be attached on a longitudinal section of the combustion chamber wall only.

Advantageously, at least two of the openings present in the combustion chamber wall have a different cross-section, with each of the at least two openings having a separate fluidic connection to at least two separate resonance chambers. This provides a very simple means of attenuating different frequencies, such as occur e.g. during the changeover from full to partial load operation.

The corrugated component advantageously has drilled holes. Cooling air can be introduced into the resonance chamber through said holes. Said cooling air cools both the corrugated component and the combustion chamber wall, e.g. by means of impingement cooling.

In an advantageous embodiment the corrugated component has at least two corrugation troughs. The corrugated component is welded or soldered to the combustion chamber wall in said corrugation troughs. This ensures in a simple manner that the resonance chambers are kept separated even during thermal expansion of the corrugated component and/or thermal expansion of the combustion chamber wall. In addition this represents a simple, heat-resistant way of fixing the corrugated component to the combustion chamber wall.

At least two separate resonance chambers advantageously have different volumes. This likewise enables different frequencies to be attenuated.

BRIEF DESCRIPTION OF THE DRAWINGS

Further features, characteristics and advantages of the present invention will emerge from the following description of exemplary embodiments with reference to the accompanying FIGS. 1-3.

DETAILED DESCRIPTION OF INVENTION

Figure 1:
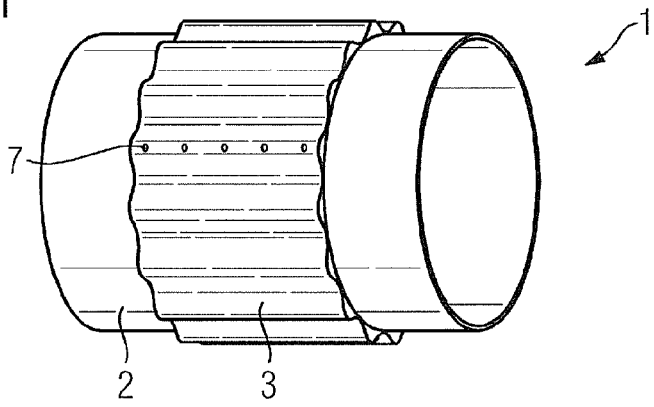
FIG. 1 shows a sectional view of an inventive gas turbine combustion chamber with corrugated component.
Figure 2:
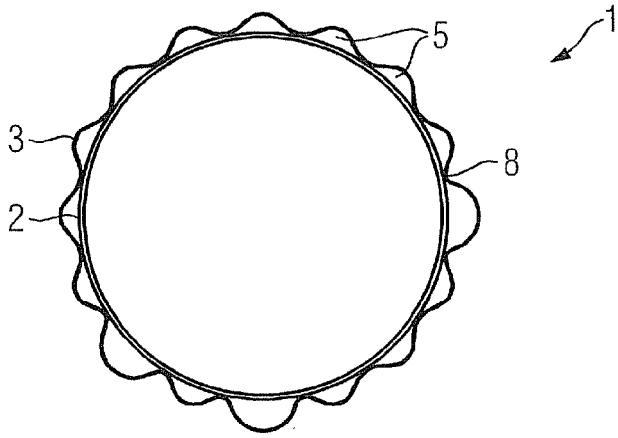
FIG. 2 shows a sectional view of an inventive gas turbine combustion chamber with corrugated component in cross-section.

FIG. 1 shows a sectional view of an inventive gas turbine combustion chamber 1. The gas turbine combustion chamber 1 additionally has a combustion chamber interior and a combustion chamber wall 2 with a substantially rotationally symmetrical cross-section. A corrugated component 3 is arranged over the entire circumference of the combustion chamber wall 2 on the side of the combustion chamber wall 2 facing away from the combustion chamber interior. In this case the corrugated component 3 can be a metal plate. In combination with the combustion chamber wall 2 (FIG. 2), the component 3 embodies a plurality of separate resonance chambers 5. Openings 4 (FIG. 3) are incorporated in the combustion chamber wall 2 in such a way that a fluidic connection is established in each case between the combustion chamber interior and one of the resonance chambers 5 (FIG. 2). At least one opening 4 (FIG. 3) is therefore associated with each resonance chamber 5 (FIG. 2). The corrugated component 3 has two locking rings 6 which are connected to the combustion chamber wall 2 in order to seal off the resonance chambers 5 (FIG. 2). The two locking rings 6 effectively constitute a cover of the corrugated component 3, which would otherwise be open at both ends. This means that the resonance chambers 5 (FIG. 2) are sealed off, so to speak, by means of said locking rings 6. The locking rings 6 can be welded or soldered on the combustion chamber wall 2. Similarly, they are additionally soldered or welded to the corrugated component 3. The resonance chambers 5 (FIG. 2) can have different volumes. This enables different frequencies to be damped. Drilled holes 7 can be incorporated in the corrugated component 3 in order to provide cooling of the corrugated component 3, but also of the combustion chamber wall 2, by means of cooling air introduced through said drilled holes 7. The cooling air enters the resonance chambers 5 (FIG. 2) through the drilled holes 7 and cools the combustion chamber wall 2, e.g. by means of impingement cooling. The drilled holes 7 are therefore incorporated above the resonance chambers 5 (FIG. 2).

FIG. 2 shows a sectional view of an inventive gas turbine combustion chamber 1 with the corrugated component 3 in cross-section. The corrugated component 3 has corrugation troughs 8. The corrugated component 3 bears directly on the combustion chamber wall 2 at said corrugation troughs 8. By preference the corrugated component 3 is welded or soldered onto the combustion chamber wall 2 in the corrugation troughs 8. This ensures that no fluidic connection is produced between the resonance chambers 5. The welding or soldering can be provided here over the entire length of the corrugated component 3. It is, however, also possible to employ a different material-to-material or positive-locking bonding method.

Figure 3:
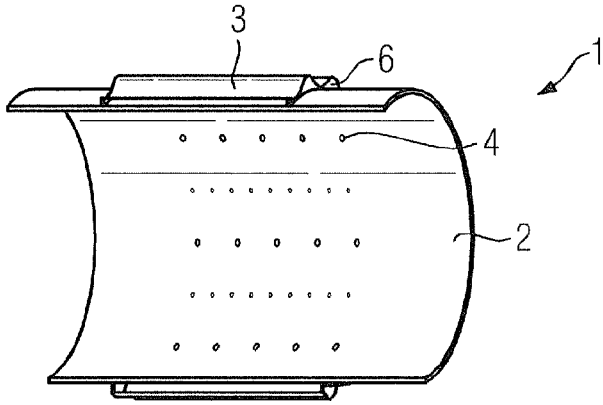
FIG. 3 shows a sectional view of an inventive gas turbine combustion chamber with corrugated component in longitudinal section.

FIG. 3 shows a sectional view of an inventive gas turbine combustion chamber 1 with corrugated component 3 in longitudinal section. The openings 4 present in the combustion chamber wall 2 to at least two separate resonance chambers 5 (FIG. 2) can have a different cross-section. This means that different frequencies can be damped. The corrugated component 3 can be mounted over the entire length of the combustion chamber wall 2 or only over a part of the length of the combustion chamber wall 2.

Simple attenuation of frequencies can be achieved by means of the inventive gas turbine with the corrugated component 3. Moreover, such a corrugated component 3 has a longer useful life than a conventional Helmholtz resonator. Furthermore, simple damping of different frequencies is possible by means of the different volumes of the resonance chambers 5 (FIG. 2).

The invention claimed is:

1. A gas turbine combustion chamber, comprising:

a combustion chamber interior and a combustion chamber wall which has a substantially rotationally symmetrical cross-section; and a corrugated component, wherein the corrugated component is arranged on an exterior side of the combustion chamber wall facing away from the combustion chamber interior over an entire cross-sectional circumference of the combustion chamber wall, wherein the corrugated component, in combination with the combustion chamber wall, embodies a plurality of separate resonance chambers, wherein a plurality of openings are incorporated in the combustion chamber wall in such a way that a fluidic connection is established in each case between the combustion chamber interior and one of the resonance chambers, and wherein the corrugated component includes two locking rings which are connected to the combustion chamber wall in order to seal off the resonance chambers.

2. The gas turbine combustion chamber as claimed in claim 1, wherein at least two of the openings present in the combustion chamber wall have a different cross-section, each of the at least two openings having a separate fluidic connection to at least two separate resonance chambers.

3. The gas turbine combustion chamber as claimed in claim 1, wherein the corrugated component includes corrugation troughs between the resonance chambers, and wherein the corrugated component is welded and/or soldered to the combustion chamber wall in the corrugation troughs.

4. The gas turbine combustion chamber as claimed in claim 1, wherein the corrugated component includes drilled holes.

5. The gas turbine combustion chamber as claimed in claim 1, wherein at least two separate resonance chambers have different volumes.

* * * * *